US005082720A

United States Patent [19]

Hayes

[11] Patent Number: 5,082,720

[45] Date of Patent: Jan. 21, 1992

[54] MELT-BONDABLE FIBERS FOR USE IN NONWOVEN WEB

[75] Inventor: Duane J. Hayes, Pierce, Wis.

[73] Assignee: Minnesota Mining and Manufacturing Company, St. Paul, Minn.

[21] Appl. No.: 191,043

[22] Filed: May 6, 1988

[51] Int. Cl.[5] ..... D03D 3/00

[52] U.S. Cl. ..... 428/224; 428/283; 428/296; 428/364; 428/369; 428/370; 428/373; 428/374

[58] Field of Search ..... 428/224, 283, 364, 369, 428/370, 373, 374, 296

[56] References Cited

U.S. PATENT DOCUMENTS

| | | | |
|---|---|---|---|
| 3,589,956 | 6/1971 | Kranz | 156/62.4 |
| 3,900,678 | 8/1975 | Aishima et al. | 428/374 |
| 4,189,338 | 2/1980 | Ejima et al. | 156/167 |
| 4,211,819 | 7/1980 | Kunimune et al. | 428/374 |
| 4,234,655 | 11/1980 | Kunimune et al. | 428/374 |
| 4,269,888 | 5/1981 | Ejima et al. | 428/296 |
| 4,406,850 | 9/1983 | Hills | 264/171 |
| 4,469,540 | 9/1984 | Furukawa et al. | 156/62.4 |
| 4,477,516 | 10/1984 | Sugihara et al. | 428/296 |
| 4,500,384 | 2/1985 | Tomoika et al. | 156/290 |
| 4,552,603 | 11/1985 | Harris, Jr. et al. | 156/167 |

FOREIGN PATENT DOCUMENTS

| | | |
|---|---|---|
| 2368554 | 10/1977 | France . |
| 1478101 | 7/1975 | United Kingdom . |

OTHER PUBLICATIONS

Patent Abstracts of Japan, vol. 7, No. 11, 18 Jan., 1983 and JP-A-57 167 418, 15 Oct. 1982.

Tomoika, "Thermobonding Fibers for Nonwovens", Nonwovens Industry, May 1981, pp. 23-31.

*Primary Examiner*—James J. Bell

*Attorney, Agent, or Firm*—Gary L. Griswold; Walter N. Kirn; David L. Weinstein

[57] ABSTRACT

Melt-bondable, bicomponent fibers suitable for use in nonwoven articles, said fibers having as a first component a polymer capable of forming fibers and as a second component a compatible blend of polymers capable of adhering to the surface of the first component. The second component has a melting temperature at least 30° C. below the melting temperature of the first component, but at least about 130° C. The blend of polymers of the second component comprises a compatible mixture of at least a partially crystalline polymer and an amorphous polymer.

14 Claims, 1 Drawing Sheet

MELT-BONDABLE FIBERS FOR USE IN NONWOVEN WEB

BACKGROUND OF THE INVENTION

1. Field of the Invention

This invention relates to bicomponent melt-bondable fibers, more particularly, such fibers suitable for use in nonwoven webs.

2. Discussion of the Prior Art

Nonwoven webs comprising melt-bondable fibers and articles made therefrom are an important segment in the nonwovens industry. These melt-bondable fibers allow fabrication of bonded nonwoven articles without the need for the coating and curing of additional adhesives, thereby resulting in economical processes, and, in some cases, fabrication of articles not capable of being made in a conventional manner.

There are two major classes of melt-bondable fibers—unicomponent fibers and bicomponent fibers. A bicomponent melt-bondable fiber is one comprising both a polymer having a high melting point and a polymer having a low melting point. Bicomponent fibers are preferred over unicomponent fibers for several reasons: (1) bicomponent fibers retain their fibrous character even when the low-melting component is at or near its melting temperature, as the high-melting component provides a supporting structure to retain the low-melting component in the general area in which it was applied; (2) the high-melting component provides the bicomponent fibers with additional strength; (3) bicomponent fibers provide loftier, more open webs than do unicomponent fibers. Bicomponent fibers are known to suffer from the following problems:

(1) Excessive thermal shrinkage. Bicomponent fibers have great latent crimp, resulting from thermal shrinkage occurring at the same time as crimp generation. In web bonding, high shrinkage results in nonwovens uneven in density and lacking in uniformity of width and thickness.

(2) Splitting of component elements. Polymers arranged either side-by-side or as sheath core fibers are easily detached in the fiber state or in the nonwoven manufacturing process.

(3) Difficulty in spinning fine fibers. It is very difficult to obtain melt-bondable bicomponent fibers finer than six denier.

Shrinkage of the web per se is not necessarily a problem. However, shrinkage is accompanied by severe curling and agglomerating of individual fibers, particularly at the points where they join. Buffing pads made of nonwoven fibers must be sufficiently uniform so that they do not mar the smooth finish of a floor when used thereon. Because of the aforementioned curling and agglomerating of the fibers in the pad, fine abrasive particles that are typically added to the pad tend to become concentrated at the points where the fibers agglomerate, i.e. the junction points thereof. This nonuniformity of abrasive distribution generally results in marring of floors during the cleaning and buffing thereof.

Kranz et al, U.S. Pat. No. 3,589,956 discloses a product made by a process wherein sheath-core bicomponent continuous strands are mechanically crimped and annealed into form, then cut to staple length and formed into a nonwoven assembly, then heated and cooled to bond. Drawing treatments performed subsequent to the spinning operation create internal stresses within the filaments and these tend to result in undesirably high shrinkage and/or crimping forces should the filaments be heated above their second-order transition temperature, i.e. of the filamentary component. Accordingly, the filaments are stabilized, e.g. by annealing, to relieve these tendencies and thus lower the retractive coefficient.

Tomioka, in an article entitled "Thermobonding Fibers for Nonwovens", Nonwovens Industry, May 1981, pp. 22–31, describes ES bicomponent fiber, which comprises polyethylene and polypropylene in a so-called modified "side-by-side" arrangement. This fiber is also disclosed in Ejima et al, U.S. Pat. No. 4,189,338. The fiber of the Ejima et al patent is prepared by (a) forming a plurality of unstretched side-by-side composite fibers consisting of a first component comprised mainly of crystalline polypropylene and a second component composed mainly of at least one olefin polymer other than crystalline polypropylene, (b) stretching said unstretched composite fibers at a stretching temperature at or above 20° C. below the melting point of said second component, (c) incorporating said stretched fibers having 12 crimps or less per 23 mm into a web, (d) subjecting said web to heat treatment at a temperature higher than the melting point of said second component but lower than the melting point of said polypropylene whereby said nonwoven fabric is stabilized mainly by melt adhesion of said second component of said composite fibers.

While heat stabilizing has been shown to be effective in reducing shrinkage of bicomponent fibers, many desirable polymeric materials are not sufficiently resistant to heat to be able to successfully undergo heat stabilization processes. Accordingly, there is a great need to provide bicomponent fibers that do not require heat stabilization in order to minimize shrinkage.

SUMMARY OF THE INVENTION

The present invention provides melt-bondable fibers and methods of making same, which fibers are suitable for use in the fabrication of nonwoven articles.

The melt-bondable fiber of this invention is a bicomponent fiber having as a first component a polymer capable of forming fibers and as a second component a blend of polymers capable of adhering to the surface of the first component. The second component has a melting temperature at least about 30° C. below the melting temperature of the first component, but equal to or greater than about 130° C. The blend of polymers of the second component comprises a compatible mixture of at least a partially crystalline polymer and an amorphous polymer where the ratio of said polymers is selected such that nonwoven webs formed from the bicomponent fibers of this invention will be capable of exhibiting a reduced level of shrinkage under conventional processing conditions and that the bicomponent fibers will not excessively curl or agglomerate when the web undergoes processing. The process for preparing the bicomponent fibers of this invention produces, by melt extrusion, a conjugate composite filament that can be of a concentric or eccentric sheath-core structure, or of a side-by-side structure. After the filament is extruded, it can be air cooled to solidify the polymers, whereupon the filament can then be stretched a desired amount, crimped, and optionally cut into suitable staple lengths. The crimped filaments or staple fibers or both can be formed into nonwoven webs, which can then be heated to a temperature above the melting temperature of the second component but below the melting temperature of the first component, and then cooled to room temperature, thereby yielding an internally bonded nonwoven web.

The fibers made according to this invention allow nonwoven webs prepared from these fibers to have a reduced level of shrinkage under conventional processing conditions. Accompanying this reduction in shrinkage is a reduction in curling or agglomerating of the individual bicomponent fibers, thereby providing a nonwoven web that will not mar smooth surfaces.

DETAILED DESCRIPTION

Figure 1:
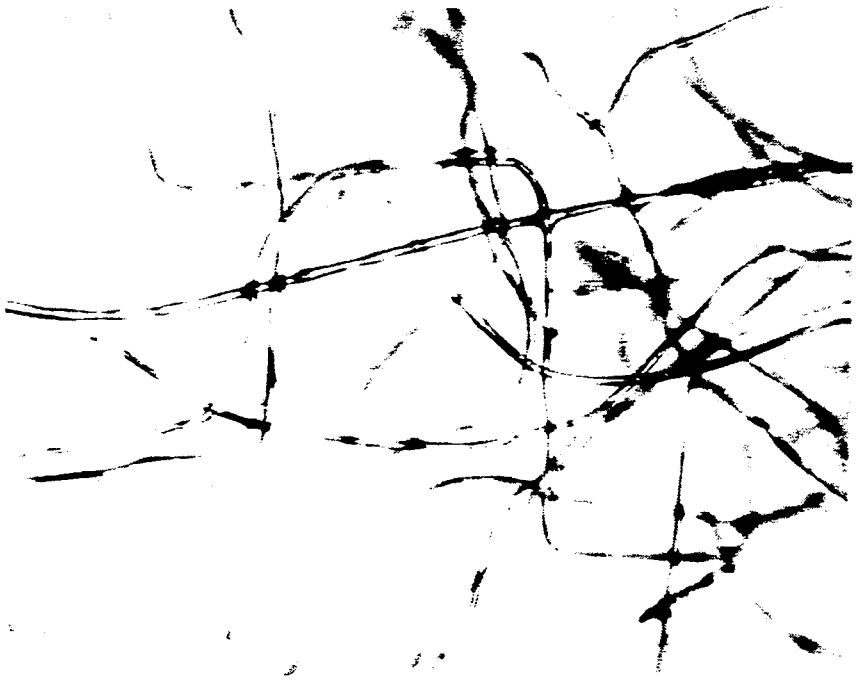
FIG. 1 is a photomicrograph, taken at 50× magnification, of a nonwoven article prepared from becomponent melt-bondable fibers of the present invention illustrating the fiber-to-fiber bonding in the fabric.

The melt-bondable fibers of this invention are bicomponent fibers having a first component and a second component. The term bicomponent refers to composite fibers formed by the co-spinning of at least two distinct polymer components, e.g. in sheath-core or side-by-side configuration. It will be understood that the term bicomponent is used in the general sense to mean at least two different components. It is entirely practical for some purposes to utilize fibers having three or more different components.

The first component comprises a melt-extrudable polymer. If this polymer were the sole component, it would preferably provide, after orientation, a fiber having a tenacity of at least about 1 g per denier. The polymer is preferably at least partially crystalline. As used herein, a "crystalline polymer" is a synthetic organic polymer that will flow upon melting and that has a relatively sharp transition temperature during the melting process. The melting temperature of the first component can range from about 150° C. to about 350° C., but preferably ranges from about 240° C. to about 270° C.

The first component must be capable of adhering to the second component and must be capable of being crimped to form textured fibers suitable for nonwoven webs. The orientation ratio of the first component depends on the requirements for the expected use, especially the property of tenacity. For such polymers as nylon and polyester, the overall draw ratio typically ranges from about 2.0 to about 6.0, preferably from about 3.0 to about 5.5. Polymers suitable for the first component include polyesters, e.g. polyethylene terephthalate, polyphenylene sulfides, polyamides, e.g. nylon, polyimide, polyetherimide, and polyolefins, e.g. polypropylene.

The second component comprises a blend comprising at least one polymer that is at least partially crystalline and at least one amorphous polymer, where the blend has a melting temperature at least 30° C. below the melting temperature of the first component. Additionally, the melting temperature of the second component must be at least 130° C., in order to avoid excessive softening resulting from the processing conditions to which the fibers will be exposed during the formation of nonwoven webs therefrom. These processing conditions involve temperatures in the area of 140° C. to 150° C. As used herein, an "amorphous polymer" is a melt-extrudable polymer that during melting does not exhibit a definite first order transition temperature, i.e. melting temperature. The polymers forming the second component must be compatible. As used herein, the term "compatible" refers to a blend wherein the components thereof exist in a single phase. The second component must be capable of adhering to the first component. The blend of polymers comprising the second component preferably comprises crystalline and amorphous polymers of the same general polymeric type, such as, for example, polyester.

Kunimune et al, U.S. Pat. No. 4,234,655 discloses heat-adhesive composite fibers having a denier within the range of 1-20, and comprising (a) a first component of crystalline polypropylene, and
(b) a second component selected from the group consisting of
  (1) an ethylene-vinyl acetate copolymer,
  (2) a saponification product thereof,
  (3) a polymer mixture of an ethylene-vinyl acetate copolymer with polyethylene, and
  (4) a polymer mixture of a saponification product of an ethylene-vinyl acetate copolymer with polyethylene.

Although Kunimune et al may possibly encompass a bicomponent fiber having a second component that comprises both an amorphous polymer and a crystalline polymer, the second component of the fiber disclosed in Kunimune et al softens excessively at temperatures of 130° C. or higher. In the process of making nonwoven abrasive articles, e.g. buffing pads, nonwoven webs are coated with adhesive at elevated temperatures, i.e. temperatures greater than 130° C., prior to introducing abrasive particles into the web. Exposure of the web of Kunimune et al to these elevated temperatures would cause that web to collapse, thereby resulting in nonwoven abrasive webs of inferior quality.

It has been discovered that the ratio of crystalline to amorphous polymer has a significant effect on both the degree of shrinkage of nonwoven webs containing the melt-bondable fibers of this invention and the degree of bonding of melt-bondable fibers during the formation of the web. In functional terms, a sufficient amount of amorphous polymer should be incorporated into the second component to decrease the melt flow rate of the second component so that the melt-bondable material of the bicomponent fiber will not excessively migrate from the fiber, thereby resulting in ineffective bonding; however, the amount of amorphous polymer in the second component must not be so excessive as to prevent the melt-bondable material of the bicomponent fiber from wetting out surfaces to which it must adhere in order to bring about effective bonding. It has been found that the preferred ratio of amorphous polymer to at least partially crystalline polymer can range from about 15:85 to about 90:10. Materials suitable for use as the second component include polyesters, polyolefins, and polyamides. Polyesters are preferred, because polyesters provide better adhesion than do other classes of polymeric materials. In the case where the blend of polymers of the second component comprises polyesters or polyolefins, increasing the concentration of amorphous polymer increases shrinkage of the bonded nonwoven web. This discovery makes it possible for the formulator of the bicomponent fibers of this invention to control the level of shrinkage of nonwoven webs formed from these bicomponent fibers.

The first and second component of the melt-bondable fiber may be of different polymer types, such as, for example, polyester and nylon, but they preferably are of the same polymer types. Use of polymers of the same type for both the first and second component produces bicomponent fibers that are more resistant to separation of the components during fiber spinning, stretching, crimping, and formation into nonwoven webs.

The weight ratio of first component to second component of the melt-bondable bicomponent fiber of this invention may vary from about 25:75 to 75:25, preferably from about 40:60 to 60:40, more preferably about 50:50. In the case where nonwoven webs are made essentially completely from melt-bondable fibers, the amount of second component can be lower, i.e. the ratio can be 75:25, because there will be a higher concentration of bicomponent fibers having the capability of providing bonding sites.

The melt-bondable fibers of this invention are disposed either in a sheath-core configuration or in a side-by-side configuration. When in the sheath-core configuration, the sheath and core can be concentric or eccentric. The sheath-core configuration is preferred with the concentric form being more preferred, as the differential stresses between the sheath and core are more random along the length of the bicomponent fiber, thereby minimizing latent crimp development caused by such differential stresses.

The higher-melting component can be spun as a core with the lower-melting component being spun as a sheath surrounding the core. The lower-melting component must be on the outer surface of the higher-melting component. Alternatively, the higher and lower-melting components may be co-spun in side-by-side relationship from spinneret plates having orifices in close proximity. Methods for obtaining sheath-core and side-by-side component fibers from different compositions are described, for example, in U.S. Pat. No. 4,406,850 and U.K. Patent No. 1,478,101, incorporated herein by reference.

The cross-section of the fibers will normally be round, but may be prepared so that it has other cross-sectional shapes, such as elliptical, trilobal, tetralobal, and like shapes. Melt-bondable fibers made according to this invention can range in size from about 1 to about 200 denier.

It is preferred to employ bicomponent fibers which do not possess latent crimpability characteristics. In this case, the fibers can be mechanically crimped in conventional fashion for ultimate use in accordance with the invention. Although less preferred, bicomponent fibers can be co-spun from two or more compositions that are so selected as to impart latent crimp characteristics to the fibers.

Where the bicomponent fibers require the application of mechanical crimp, conventional devices of the prior art may be utilized, e.g. a stuffing box type of crimper which normally produces a zigzag crimp, or apparatus employing a series of gears adapted to apply a gear crimp continuously to a running bundle of filaments. The particular type of crimp is not a part of this invention, and it can be selected depending upon the type of product to be ultimately formed. Thus the crimp may be essentially planar or zigzag in nature or it may have a three-dimensional crimp, such as a helical crimp. Whatever the nature of the crimp, it is preferred that the bicomponent filament have a three-dimensional character.

The bicomponent filaments can be cut to staple length in conventional manner. Staple length preferably ranges from about 25 mm to 150 mm, more preferably from about 50 mm to about 90 mm.

Once the fibers have been appropriately crimped and reduced to staple length, they may then be fabricated into nonwoven webs, which can be further treated to form nonwoven abrasive webs, as by incorporating abrasive material into the web. Techniques for fabricating nonwoven abrasive webs are described in Hoover, U.S. Pat. No. 2,958,593, incorporated herein by reference.

Many types and kinds of abrasive particles and binders can be employed in the nonwoven webs derived from the bicomponent fibers of this invention. In selecting these components, their ability to adhere firmly to the fibers employed must be considered, as well as their ability to retain such adherent qualities under the conditions of use.

Generally, it is highly preferable that the binder materials exhibit a rather low coefficient of friction in use, e.g., they do not become pasty or sticky in response to frictional heat. However, some materials which of themselves tend to become pasty, e.g., rubbery compositions, can be rendered useful by appropriately filling them with particulate fillers. Binders which have been found to be particularly suitable include phenolaldehyde resins, butylated urea aldehyde resins, epoxide resins, polyester resins such as the condensation product of maleic and phthalic anhydrides and propylene glycol, acrylic resins, styrene-butadiene resins, and polyurethanes.

Amounts of binder employed ordinarily are adjusted toward the minimum consistent with bonding the fibers together at their points of crossing contact, and, in the instance wherein abrasive particles are also used, with the firm bonding of these particles as well. Binders, and any solvent from which the binders are applied, also should be selected with the particular fiber to be used in mind so embrittling penetration of the fibers does not occur.

Representative examples of abrasive materials useful for the nonwoven webs of this invention include, for example, silicon carbide, fused aluminum oxide, garnet, flint emery, silica, calcium carbonate, and talc. The sizes or grades of the particles can vary, depending upon the application of the article. Typical grades of abrasive particles range from about 36 to about 1000.

Conventional nonwoven web making equipment can be used to make webs comprising fibers of this invention. Air laid nonwoven webs comprising fibers of this invention can be made using equipment commercially available from Dr. O. Angleitner (DOA), Proctor & Schwarz, or Rando Machine Corporation. Mechanical laid webs can be made using equipment commercially available from Hergeth KG, Hunter, or others.

The melt-bondable fibers of this invention can be used alone or in physical mixtures with other crimped, non-adhesive fibers to produce bonded nonwoven webs. Depending upon the use of the nonwoven web, the size of the fiber is selected to provide nonwoven webs having desired characteristics, such as, for example, thickness, openness, resiliency, texture, strength, etc. Typically, the size of the melt-bondable fiber is similar to that of other fibers in a nonwoven web. Wide variance in fiber size can be used to produce special effects. The melt-bondable fibers of this invention can be used as the nonwoven matrix for abrasive products such as those described in U.S. Pat. No. 3,958,593. The following, non-limiting examples will further illustrate this invention.

EXAMPLES

Commercially available spinning equipment comprising extruders for plastics, a positive-displacement melt pump for each polymer melt stream, and a spin pack designed to converge the polymer melt streams into a multiplicity of sheath-and-core filaments for production of melt-bondable fibers was used to prepare the fibers of the examples. Immediately after the filaments were formed they were cooled by a cross-flow of chilled air. The filaments were then drawn through a series of heated rolls to a total attenuation ratio of between 3:1 and 6:1. The drawn melt-bondable filaments were then wound onto a core for further processing. In a separate processing step, the straight filaments were crimped by means of a stuffing-box crimper which produced about 9 crimps per 25 mm. The crimped fibers were then cut into about 40 mm staple lengths suitable for processing through equipment for forming nonwoven webs.

Shrinkage of bonded nonwoven webs containing melt-bondable fibers of this invention was evaluated by preparing an air laid unbonded nonwoven web containing about 25% by weight crimped melt-bondable staple fibers and about 75% by weight crimped conventional staple fibers. After the width of the unbonded web was measured, the web was heated to cause the melt-bondable fiber to be activated, i.e. melted, whereupon the web was cooled to room temperature and width was measured again. The percent shrinkage from the width of the unbonded web was calculated.

A second method that was used to evaluate shrinkage of nonwoven webs comprising melt-bondable fibers involved the use of an automated dynamic mechanical analyzer ("Rheometrics Solids Analyzer", Model RSA-II). In this method, 16 fibers, each 38 mm long, were held under a static constant strain of 0.30% and subjected to a dynamic strain of 0.25% as a 1 Hertz sinusoidal force. The fibers were heated at a rate of 10° C. per minute. The results of this test were reported as percent change of sample length.

EXAMPLE 1

Chips made of poly(ethylene terephthalate) having an intrinsic viscosity of 0.5 to 0.8 were dried to a moisture content of less than 0.005% by weight and transported to the feed hopper of the extruder which fed the core melt stream. A mixture consisting of 75% by weight of semicrystalline chips of a copolyester having a melting point of 130° C. and intrinsic viscosity of 0.72 ("Eastobond" FA300, Eastman Chemical Company) and 25% by weight of amorphous chips of a copolyester having an intrinsic viscosity of 0.72 ("Kodar" 6763, Eastman Chemical Co.) was dry-blended, dried to a moisture content of less than 0.01% by weight, and transported to the feed hopper of the extruder feeding the sheath melt stream. The core stream was extruded at a temperature of about 320° C. The sheath stream was extruded at a temperature of about 220° C. The molten composite was forced through a 0.5 mm orifice, and pumping rates were set to produce filaments of 50:50 (wt./wt.) sheath to core ratio. The fibers were then drawn in three steps with draw roll speeds set to produce fibers of 15 denier per filament with an overall draw ratio of about 5:1 to produce melt-bondable fibers, which were then crimped (9 crimps per 25 mm) and cut into staple fibers (40 mm long).

The fibers were then mixed with conventional polyester fibers (12 crimps per 25 mm, 15 denier, 40 mm long) at a ratio of 25% by weight melt-bondable fibers and 75% by weight conventional fibers, and the resulting mixture processed through air-laying equipment ("Rando-Web" machine) to obtain a fiber mat weighing about 120 g/m$^2$. The nonwoven mat was then heated in an oven to a temperature above the softening point of the sheath of the bicomponent fiber component but below the softening point of the core of the bicomponent fiber component. The bonded nonwoven webs were then allowed to cool. Web strength of the bonded nonwoven sample webs were measured by cutting 50 mm by 175 mm samples from the web in the cross machine direction. Each sample was placed in an "Instron" tensile testing machine. The jaws holding the sample were separated by 125 mm. They were then pulled apart at a rate of 250 mm per minute. Results are reported in g/50 mm width.

Fiber shrinkage was measured by means of the "Rheometrics Solids Analyzer", Model RSA-II.

EXAMPLE 2

Example 1 was repeated with the sole exception being that the ratio of sheath component was changed to 50% by weight amorphous polyester and 50% by weight semicrystalline polyester.

EXAMPLE 3

Example 1 was repeated with the sole exception being that the ratio of sheath component was changed to 75% by weight amorphous polyester and 25% by weight semicrystalline polyester.

MELT FLOW RATE

The melt flow rate of the adhesive component, i.e. the sheath component, of the melt-bondable fibers of Examples 1, 2, and 3 were measured according to ASTM D 1238 at a temperature of 230° C. and a weight of 2160 g. The results are shown in Table I.

TABLE I

| Example | Melt flow rate of sheath component (g/10 min) |
|---|---|
| 1 | 54 |
| 2 | 29 |
| 3 | 10 |

From the data in Table I, it can be seen that as the concentration of amorphous polymer in the second component increases, the melt flow rate of the second component decreases. Accordingly, bonding can be controlled with the bicomponent fibers of this invention.

COMPARATIVE EXAMPLE A

A commercially available melt-bondable 15 denier per filament sheath/core polyester fiber ("Melty" Type 4080, Unitika, Ltd., Japan) was evaluated for denier, tenacity, and fiber shrinkage rate. Samples of nonwoven webs were prepared by blending about 25% by weight of "Melty" Type 4080 fibers with about 75% by weight of a 15 denier polyester staple fibers, 15 denier per filament, 40 mm long and having about 12 crimps per 25 mm. Samples were then processed to form fiber mats and bonded nonwoven webs in the same manner as described in Example 1 and repeated in Examples 2 and 3.

Table II sets forth data for comparing tenacity, fiber shrinkage, web shrinkage, and web strength of the bicomponent fibers of Examples 1, 2, and 3 and Comparative Example A.

TABLE II

| Example | Tenacity (g/denier) | Fiber Shrinkage (%) | Web Shrinkage (%) | Web Strength (g/50 mm) |
|---|---|---|---|---|
| 1 | 2.6 | 0 | 6 | 3550 |
| 2 | 3.5 | 10 | 11 | 680 |
| 3 | 3.0 | 12 | 11 | 250 |
| Comp. A | 2.5 | 0 | 9 | 2540 |

From the results of Table II, it can be concluded that as the concentration amorphous component increases, melt flow rate decreases, fiber shrinkage and web shrinkage increase, and web strength decreases. It can be seen that while the fibers of Example 1 shows equivalent fiber shrinkage to the fibers of Comparative Example A, web shrinkage has decreased from a value of 9% to a value of 6% and web strength has increased by a factor of approximately 40% (3550/2540×100%).

Figure 2:
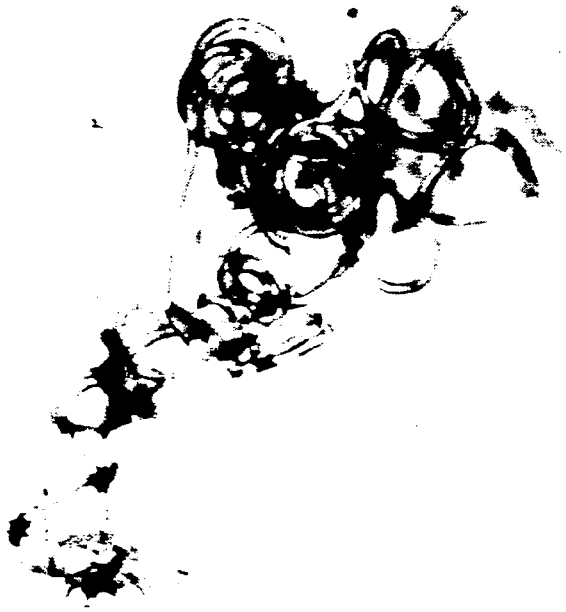
FIG. 2 is a photomicrograph, taken at 50× magnification, of a nonwoven article prepared from bicomponent melt-bondable fibers of the prior art illustrating the fiber-to-fiber bonding in the fabric.

In order to meaningfully compare the bicomponent fibers of the present invention with bicomponent fibers of the prior art, it is useful to compare a photomicrograph of a portion of a web containing melt-bondable bicomponent fibers of the present invention (FIG. 1) with a photomicrograph of a portion of a web containing melt-bondable bicomponent fibers of the prior art (FIG. 2). In FIG. 1, it can be seen that the bicomponent fibers show little curl or agglomeration. In contrast, significant curl and agglomeration can be seen in FIG. 2. Accordingly, fewer abrasive particles will settle near the junction points of fibers of FIG. 1 than will settle near the junction points of fibers of FIG. 2. As stated previously, this settling of abrasive grains is a major cause of marring of flat surfaces by nonwoven abrasive pads.

Various modifications and alterations of this invention will become apparent to those skilled in the art without departing from the scope and spirit of this invention, and it should be understood that this invention is not to be unduly limlited to the illustrative embodiments set forth herein.

What is claimed is:

1. A bicomponent fiber comprising:

(a) a first component comprising an oriented, crimpable, at least partially crystalline polymer, and adhering to the surface of said first component, (b) a second component, which comprises a compatible blend of polymers, comprising:

(1) from about 15 to about 90% by weight of at least one amorphous polymer, and (2) from about 85 to about 10% by weight of at least one at least partially crystalline polymer, the melting temperature of said second component being at least 30° C. lower than the melting temperature of said first component, but at least equal to or in excess of about 130° C., the concentration of said amorphous polymer of said second component being sufficiently high to reduce the melt flow rate of said at least partially crystalline polymer of said second component, but not so high as to prevent said bicomponent fiber from bonding to a like bicomponent fiber, provided that if the bicomponent fiber is spun in a sheath-core configuration, said first component is the core and said second component is the sheath.

2. The fiber of claim 1 wherein said first component is a polymer selected from the group consisting of polyesters, polyphenyl sulfides, polyamides, and polyolefins.

3. The fiber of claim 1 wherein said first component, if used alone, would have a tenacity of at least 1 g/denier.

4. The fiber of claim 1 wherein the orientation ratio of said first component ranges from about 2.0 to about 6.0.

5. The fiber of claim 1 wherein said amorphous polymer of said second component is selected from the group consisting of polyesters, polyolefins, and polyamides.

6. The fiber of claim 1 wherein said at least partially crystalline polymer of said second component is selected from the group consisting of polyesters, polyolefins, and polyamides.

7. The fiber of claim 1 wherein said amorphous polymer of said second component and said at least partially crystalline polymer of said second component are of the same polymeric class.

8. The fiber of claim 1 wherein said amorphous polymer of said second component and said at least partially crystalline polymer of said second component are polyesters.

9. The fiber of claim 1 wherein the weight ratio of said first component to said second component ranges from about 75:25 to about 25:75.

10. The fiber of claim 1 wherein the weight ratio of said first component to said second component ranges from about 60:40 to about 40:60.

11. A nonwoven web comprising a multiplicity of fibers of claim 1.

12. The nonwoven web of claim 11 further including a multiplicity of abrasive particles.

13. The fiber of claim 1 wherein said first component and said second component are spun in a sheath-core configuration.

14. The fiber of claim 1 wherein said first component and said second component are spun in a side-by-side configuration.

* * * * *